US005503335A

United States Patent [19]

Noakes et al.

[11] Patent Number: 5,503,335

[45] Date of Patent: Apr. 2, 1996

[54] ELECTROSTATIC SPRAYING DEVICE AND METHOD OF FABRICATION THEREOF

[75] Inventors: Timothy J. Noakes, Pantymyn, England; Michael L. Green, Nannerch, Wales

[73] Assignee: Imperial Chemical Industries PLC, London, England

[21] Appl. No.: 211,633

[22] PCT Filed: Sep. 17, 1992

[86] PCT No.: PCT/GB92/01712

§ 371 Date: Jul. 18, 1994

§ 102(e) Date: Jul. 18, 1994

[87] PCT Pub. No.: WO93/06937

PCT Pub. Date: Apr. 15, 1993

[30] Foreign Application Priority Data

| | | | |
|---|---|---|---|
| Oct. 10, 1991 | [GB] | United Kingdom | 9121535 |
| Mar. 8, 1992 | [GB] | United Kingdom | 9219000 |
| Mar. 13, 1992 | [GB] | United Kingdom | 9205486 |

[51] Int. Cl.[6] ..... B05B 5/025; B05B 5/16

[52] U.S. Cl. ..... 239/690; 239/145

[58] Field of Search ..... 239/690, 34, 44, 239/145, 326

[56] References Cited

U.S. PATENT DOCUMENTS

| | | | |
|---|---|---|---|
| 4,846,407 | 7/1989 | Coffee et al. | 239/690 |
| 5,196,171 | 3/1993 | Peltier | 239/44 |

FOREIGN PATENT DOCUMENTS

| | | |
|---|---|---|
| 20049 | 12/1980 | European Pat. Off. . |
| 120633 | 10/1984 | European Pat. Off. . |
| 486198 | 5/1992 | European Pat. Off. . |

OTHER PUBLICATIONS

Patent Abstracts of Japan, Jul. 1985—publication No. JP58067375, application No. JP810165816, abstract vol. 007155.

*Primary Examiner*—Karen B. Merritt
*Attorney, Agent, or Firm*—Cushman Darby & Cushman

[57] ABSTRACT

An electrostatic device for spraying liquids comprises a nozzle in the form of a wick which is contacted with a reservoir containing the liquid to be sprayed, high electrical potential being applied to the liquid in the vicinity of the spraying tip of the nozzle whereby the liquid is drawn out preponderantly under the influence of electrical forces into ligaments which break up to form a spray of electrically charged liquid droplets. The wick is fabricated from sheet of a resiliently deformable polymeric foam material of open celled structure and an edge of the sheet material is profiled to form a plurality of sites at which liquid ligaments can be produced. Typically a toothed profile is employed in which a plurality of teeth form the sites at which ligament formation occurs.

24 Claims, 2 Drawing Sheets

ELECTROSTATIC SPRAYING DEVICE AND METHOD OF FABRICATION THEREOF

This invention relates to the electrostatic spraying of liquids.

It is known from Applicant's prior EP-A-120633 to effect electrostatic spraying by the application of high potential to liquid supplied to a nozzle which comprises a porous wick-type element formed of the types of porous felt or fibre bundles or plastic pads widely used in graphic implements such as felt or porous plastic tip markers or felt- or fibre-tip pens. In the case of porous pad or fibre bundle nozzle constructions, reference is made to the use of nozzles having a point, bullet head or hemispherical configuration. In the case of felt-tip markers, reference is made to such markers having a chisel-edge configuration.

It is also known from Applicant's prior EP-A-243031 to provide an electrostatic spraying device in which the droplet size can be controlled without the aid of a field adjusting electrode (FAE) by forming a spraying edge of the device with a toothed profile so as to afford a plurality of sites at which the liquid is drawn out preponderantly by electrostatic forces into ligaments which break up into electrically charged particles. The spraying edge is defined by a component over a surface of which the liquid is fed by gravity towards a toothed edge of the component.

The present invention is concerned with an improved form of electrostatic spraying device in which supply of liquid to the spraying edge is rendered substantially independent of gravity without the need for employing a source of pressure in order to effect liquid feed.

According to one aspect of the present invention there is provided an electrostatic spraying device comprising: a spraying nozzle in the form of a wick type element: a reservoir for containing liquid to be supplied to the nozzle; and means for applying high voltage to the liquid at the nozzle to cause the liquid to be drawn into ligamentary form and thereafter break up into electrostatically charged droplets: said element being composed of a foam material having an open cell structure through which the liquid is drawn by capillary action.

In contrast with the above mentioned prior art, the spraying nozzle in a device according to said one aspect of the present invention comprises a foam material through which the liquid is drawn by capillary action.

Preferably the foam material is resiliently deformable. The use of a spraying nozzle composed of a resiliently deformable material confers reduced susceptibility to spraying being deleteriously affected as a result of impacts to the nozzle in use. For instance, where as in the prior art a nozzle is composed of a relatively rigid structure such as a bundle of fibres, an impact to the nozzle may result in splitting of the bundle or one or more fibres breaking off from the bundle. Depending on the extent of the damage, the nozzle may cease to function altogether or it may produce a spray in directions which are not desired—for example, towards the body of the sprayer with consequent contamination. In contrast, a nozzle composed of a resiliently deformable material, if impacted, will usually absorb the impact by yielding or deflecting and then resile to its former orientation.

Conveniently the foam material is shaped so as to present at least one feature from which the liquid discharges in the form of a plurality of ligaments.

Advantageously the foam material is in the form of a sheet and is shaped in such a way that each such feature presents a crest extending between opposite faces of the sheet.

Where the foam material is formed from sheet material, each such feature may be formed by cutting the foam material through its thickness.

In one embodiment of the invention, the foam material is in the form of a sheen and is formed with a toothed profile presenting at least one crest extending between opposite faces of the sheet. Usually the included angle at the crest will be no greater than 100°.

In accordance with a preferred feature of the invention the element terminates in at least one tip having a chisel edge configuration, with an edge which is substantially rectilinear or arcuate in a plane normal to the axis of the element. The extremities of the nip may be substantially right angled whereby the liquid tends to be drawn into two well-defined primary ligaments at said extremities.

According to a second aspect of the invention there is provided a ligament mode electrostatic spraying device for spraying liquids in which the liquid is sprayed from a profiled edge of a strip of sheet material composed of material having open porosity and providing capillary feed of liquid to said profiled edge.

Further broad aspects of a device in accordance with the present invention are described hereinafter.

Where the wick type element is in the form of a strip of porous or foam material, the strip will usually be of elongated configuration with a width greater than its thickness, the profiled spraying edge being provided at one end of the strip. Thus, the crest or crests presented by the profiled edge will usually be of a length less than the width of the strip.

In each of the various aspects and features defined herinabove, said material is preferably composed of hydrophobic material. In this context, by "hydrophobic", we mean that the inherent absorbency of the material when in a pre-dried condition is such that it will absorb no more than 0.5% by weight of water if exposed to air having 50% RH at a temperature of 23° C. and a pressure of 1 atmosphere.

The materials of which fibre and felt-tip markers and pens are widely fabricated, eg cellulosic and nylon materials, tend to be a hydrophilic nature and we have found that such materials have a propensity to corona when used in relatively had conditions, and this is thought to be attributable to the absorption of water into the nozzle material rendering it more conductive and hence prone to corona discharge.

It is important that the foam or porous material of which the nozzle or wick type element in accordance with any one of the aspects of the invention defined above should be one that provides a substantial capillary rise especially where the level of the liquid in the reservoir falls as the liquid is sprayed from the nozzle. For effective capillary action, it is desirable that the pore size of the material, eg the cells of the foam in the case of a foam material, are not too large. In addition, for devices intended for the spraying of deodorant and like personal care and hygiene liquid compositions having relatively low viscosity and resistivity (eg. a viscosity of the order of 10 cP and a resistivity of the order of $5\times10^6$ ohm cm), we find that it is also desirable for the material of which said material is composed to have a dielectric constant of at least 2.8 (measured at $10^6$ Hz) and to be in the form of a foam, especially when flow races in excess of about 1.5 mg/min are required. The reference here to the dielectric constant relates to the material per se rather than the bulk dielectric constant of the foam or porous material and air contained thereby. It will be understood that the dielectric constant can be readily measured by subjecting the material to compression in order to achieve a condition in which all of the voids are substantially eliminated.

Where the nozzle is fabricated from sheet material or a scrip of such material, the thickness of the sheet material need not be any greater than 2 mm (preferably no greater than 1 mm). We have found that relatively thin sheet materials can be employed whilst securing production of multiple liquid ligaments at the or each spraying tip or crest. This arises because the extremities of the tip edge, ie those locations at which the nip edge intersects each of the major faces of the sheet material, afford sites at which ligament formation is favoured resulting in the production of primary ligaments at these sites. In addition, further ligaments may issue at sites intermediate these extremities.

According to a further aspect of the invention there is provided a method of electrostatically spraying a liquid comprising: feeding the liquid from a reservoir thereof to an element of sheet material having open porosity and defining at least one spraying tip or crest of chisel edge configuration whereby the liquid is drawn by capillary action to the tip(s) of the element; and applying high voltage to the liquid at said tip(s) or crest(s) so that the liquid is caused to issue in the form of ligaments at a plurality of sites along the chisel edge of the or each tip, which ligaments thereafter break up to form a spray of liquid droplets.

Also according to the present invention there is provided a method of producing a cartridge for use in an electrostatic spraying device comprising:

forming from a sheet of resiliently deformable non-fibrous. non-felted, hydrophobic material having open porosity a wick type element with a profiled spraying edge; and assembling said element to a container for liquid suitable for electrostatic spraying by inserting said element through an opening in the container so that said spraying edge projects from the container and a portion of the element extends into the interior of the container to provide a capillary feed path for liquid from the container to the profiled spraying edge.

The foam material may be one which comprises a sandwich-like structure with first and second substantially impermeable skins enclosing therebetween a mass of interconnected cells. When such a material is used, the spraying edge is formed in such a way that the cells are exposed at the spraying edge. To allow ingress of liquid into the cellular structure, at least part of the skin on at least one side of the structure mat be removed.

The porous element is conveniently so arranged that the profiled spraying edge is of annular or part-annular configuration, especially where the profiled edge serves to provide a number of tips or teeth from which spraying is effected. Thus, for example, the nozzle may be produced from a sheet of foam material formed an least in the vicinity of the spraying edge into a tubular or part-tubular configuration with one end thereof having said profile.

However, for some applications of the invention we do not exclude the case where said wick type element comprises a solid body of porous material, eg a substantially cylindrical body of foam material, with one end thereof formed with said spraying feature or profile. For example, the solid body may have a recess in one end thereof so as to present an annular edge on which a toothed profile is provided. Also we do not exclude the possibility of the spraying edge having a configuration other than annular or part-annular; for instance, it may have a substantially rectilinear configuration.

In preferred embodiments of the invention, the or each tip or profile feature from which spraying takes place terminates in the form of a tooth comprising a first pair of flanks converging no a substantially linear edge at the tip of the tooth and a second pair of flanks located in planes generally orthogonal no the first pair so that the tooth tip comprises a substantially linear edge extending between the second flanks. The tooth edge and the second pair of flanks may be intersect at substantially right angles to form sites (which may but need not necessarily be relatively sharply radiussed) from which ligaments can be drawn under the influence of the electrostatic forces generated in use. Ligaments may also be produced at intermediary sites between the locations of intersection.

In a preferred embodiment of the invention, the device does not incorporate any structure forming a FAE, ie. the nozzle is so arranged than the field strength produced when liquid is present at the tips of the toothed profile is substantially independent of any low potential influence from any low potential influences from the device.

Conveniently, the device comprises a housing for accomodating the reservoir and the high voltage means which, typically, includes a high voltage generator and a low voltage source, for instance one or more batteries, for powering the generator. In the case where the liquid composition is a personal care product, the device is typically designed so as to be suitable for hand held use. Where the liquid composition is an air freshening fragrance or the like for dispersal in the air, the device may be designed so as to free standing on a flat horizontal surface such as a shelf or table top with the porous element projecting vertically upwards: for instance, the housing may have a flat base or formations for contact with a horizontal surface so that the housing is oriented in such a way than the porous element is disposed with its axis substantially vertical. Alternatively, or additionally, the housing may be intended to be suspended from a generally vertical surface such as a wall in which case it will be provided with a suspension means so arranged that the housing will be appropriately oriented in use. For example, the housing may include a wall contacting surface or formations which, in conjunction with the suspension means, ensures that the porous element is appropriately oriented when the housing is mounted on the wall.

The battery supply may be rechargeable and the device may incorporate circuitry and terminals allowing direct connection to a mains supply for recharging.

Switch means will normally be provided to enable the high potential applied to the nozzle to be switched on and off. The switch means may be operable by means of a manually displaceable actuator or alternatively may be touch sensitive so that the high potential is applied to the nozzle whenever the device is held in the hand without the need for any conscious action on the part of the user.

The invention will now be described by way of example only with reference to the accompanying drawings in which.

Figure 1:
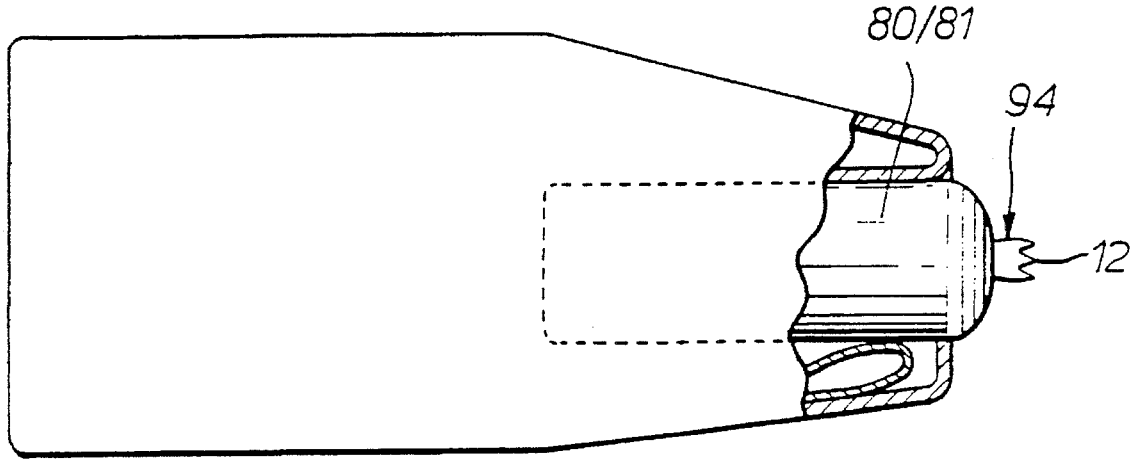
FIG. 1 is a schematic view of a device in accordance with the invention.

Referring to FIG. 1, the device may be generally constructed and arranged to operate in the same manner as the device described in connection with FIGS. 5 to 9 of EP-A-120633 and reference should be made to the latter for further details, The liquid composition to be sprayed is contained within a cartridge 80/81 which may enclose a wad or strip of porous material impregnated with the liquid for supply to a nozzle 94 constituted by a porous wick-type element 10 (see FIG. 3) which extends into the cartridge to enable liquid to be fed by capillary action to the tip of the nozzle. Alternatively, where the device is intended to be used in an orientation such that the nozzle produces an upwardly directed spray, as in the case for example of a table or shelf standing room freshening device for spraying fragrance, the liquid may be stored in the cartridge as a body of liquid as such with the wick element extending into the body of liquid to such an extent that the wick element is supplied with liquid irrespective of whether the cartridge is full or approaching a near empty condition.

Figure 2:
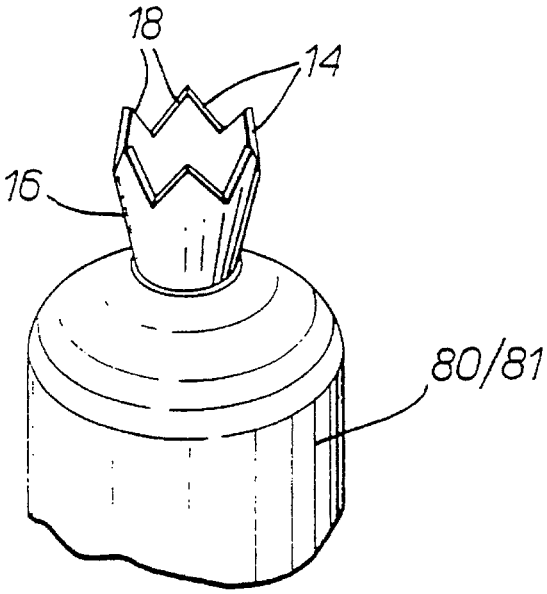
FIG. 2 is an enlarged perspective view of the nozzle spraying edge of the device.
Figure 3:
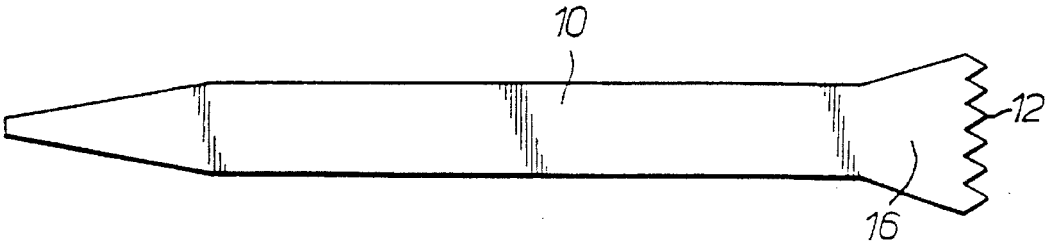
FIG. 3 is a view showing the configuration of a section of foam sheet material from which the nozzle is formed.

The nozzle 94 terminates in a spraying edge 12 having a profile which in the illustrated embodiment comprises a plurality of teeth 14 from which the liquid is projected in use in the form of a plurality of ligaments per tooth, the ligaments being formed and projected preponderantly under the influence of electrostatic forces and thereafter breaking up into charged droplets. As shown in FIGS. 2 and 3, the spraying edge has 6 teeth but the number may vary according to requirements. For example, if the flow rate required for a given application is low, then the number of teeth may be somewhat less. Compared with a point or bullet head type nozzle configuration as disclosed in EP-A-120633, it will be understood that the toothed profile employed in the embodiments of the present invention generates at least two liquid ligaments per tooth and the toothed profile may be adapted according to the number of ligaments (ie. two or more) needed to secure a desired flow rate.

The nozzle 94 is fabricated from a strip cut from a sheet of material having open porosity, eg an open called foam material. The strip has the section shown in FIG. 3, which section is formed into a tubular configuration and is inserted as push fit through an opening in the cartridge 80/81 so that the main body of the insert projects virtually the full length of the container, leaving a small end portion of the strip projecting externally from the cartridge. The externally projecting portion 16 bears the toothed profile and is of outwardly flared configuration which has the effect of increasing the swath width of the spray and also reduces the extent that the local field strength at each tooth influences the remainder.

At the end opposite to the toothed profile, the strip 10 is tapered so that when the strip is furled about its axis of elongation, the tapered region forms a lead-in to facilitate insertion through the opening in the cartridge. If desired, the strip 10 may be furled into a tubular configuration and the edges that meet may be secured together. However, this will not usually be necessary since the close fit within the cartridge opening serves to retain the strip 10 in a tubular configuration in the region of the toothed profiling. Once the strip 10 has been inserted into the cartridge, that part which is within the cartridge interior may tend to unfurl but this does not particularly matter and may be advantageous in exposing a larger surface area of the strip 10 to the liquid.

The foam material typically comprises an elastically deformable sheet material having a sandwich-like structure with a mass of interconnecting open cells enclosed between a pair of skins so that the cells provide labyrinthine passageways extending throughout the strip 10. To be suitable for the purposes of the present invention, the sheet material should be readily capable of being cut through the thickness thereof to produce sharp edged features. The strip 10 is cut perpendicularly to the skins so that cells are exposed at the cut edges, which extend perpendicular to the paper in FIG. 3. In addition, at least one of the skins may be sanded so as facilitate ingress of liquid into the strip 10 via these faces. It will be understood that liquid penetrating into the strip 10 will be fed by capillary action to the tips or crests of the teeth 14 where an intense electrical field can be produced by virtue of the relatively sharp tip to effect formation of the liquid at each tip into one or more ligaments which subsequently break up into a spray of droplets. Usually the included angle between the flanks of each tooth will be no greater than 100° and typically somewhat less, eg of the order of 60°. A particularly suitable porous material for use in fabricating the nuzzle is porous foamed polyurethane sheet, such as polyesterurethane sheet marketed under the trade names "Permair F", "Permair FS" and "Permair S" by Permair PLC of Kings Lynn, England which are available in various sheet thicknesses and pore sizes and are used primarily as air filtration media. This material can be readily cut to form the nozzle strip shown in FIG. 3. Typically, the thickness of the Permair foam used for the purposes of the present invention is less than 2 mm, eg 0.5 mm: in other words, the strip 10 shown in FIG. 3 is typically 0.5 mm thick as considered in a direction perpendicular to the plane of the paper and its central width is typically 4 mm.

Materials other than foamed polyurethanes may be used; clearly the pore size of any material selected should be sufficiently small to ensure adequate capillary rise. In addition, it is desirable that the material should have a dielectric constant of at least 2.8 (measured at $10^6$ Hz) in order that the material is adequately polar to produce effective capillary action. Further, to avoid undesirable corona discharge, especially in humid conditions, the material when exposed to 50% RH at 23° C. and 1 atmosphere should desirably, when in a pre-dried state, absorb no more than 0.5% by weight of water, assuming exposure to such conditions for a period of time sufficient to achieve an equilibrium state. "Permair F" has been found no be a particularly suitable material meeting these criteria.

The liquid composition contained in the cartridge 80/81 typically contains one or more volatile components, for example a moderately volatile scent oil and an alcohol (highly volatile), the formulation typically having a resistivity in the range of $1\times10^5$ to $1\times10^7$ ohm cm.

The rate of delivery of the liquid composition using a porous wick-type nozzle is ultra-low, eg of the order of 1 μl/min or less, which is desirable for many forms of personal care and hygiene products. However, if the nozzle terminates in a point or bullet head configuration, the rate of delivery may rend to be unacceptably slow. The rate of delivery can be increased by providing a nozzle that produces multiple ligaments. In accordance with the present invention, multiple ligaments are formed by configuring the nozzle tip 94 with a toothed profile from the or each tooth of which a plurality of ligaments is drawn in operation of the device. It is possible to secure multiple ligament production from each tooth by imparting a chisel-shape to the teeth such that the tip proper is formed by a sharp edge 12 extending generally perpendicular to the line extending between the tips of adjacent teeth. Thus, as shown in FIG. 4, each tooth tip as seen in a plane perpendicular to the major faces of the strip 10 shown in FIG. 3, comprises a crest in the form of a linear edge which extends a distance corresponding to the thickness of the material and intersects the major faces at right angles to form sites 20 from which ligaments are drawn when high potential is applied to the liquid at the nozzle tip.

Figure 4:
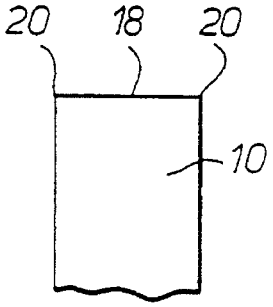
FIG. 4 is a fragmentary view showing the tip of one of the nozzle teeth as viewed in a direction parallel to the major faces of the sheet from which the nozzle is formed
Figure 5:
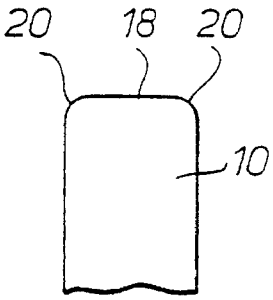
FIG. 5 is a view similar to that of FIG. 4 but showing a modified form of tooth tip.

In the embodiment shown in FIG. 4, the main sites for ligament formation are the points of intersection 20; however, some secondary ligament formation may also be observed at random locations along the edge 18 between the points 20. The number of ligaments produced may be increased by radiussing the teeth as shown in FIG. 5.

Figure 6:
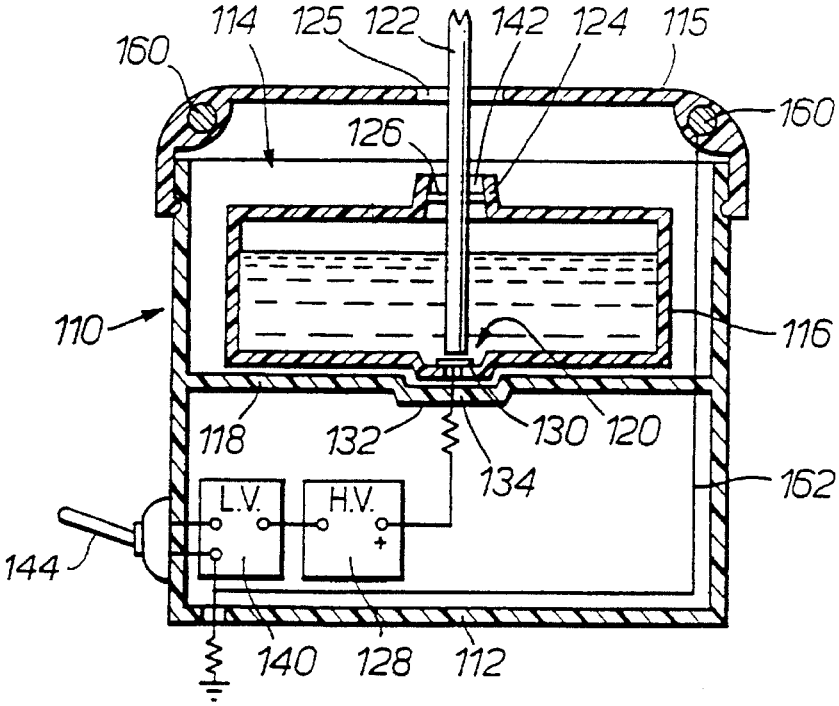
FIG. 6 is a diagrammatic view partly in section of a device for spraying air freshening fragrances.

Referring now to FIG. 6, the invention is shown embodied in an air freshener device. The device comprises a housing 110, the bottom wall 112 of which is intended in use to be supported on a generally horizontal surface. The housing 110 is provided with a compartment 114 to which access can be gained by removal of cover 115 so that a cartridge 116 containing the fragrant liquid composition to be sprayed can be inserted into the compartment. The liquid is one which is suitable for electrostatic spraying and is selected to have suitable properties, eg resistivity and viscosity, for this purpose. The cartridge 116 is of squat parellelopiped configuration, its smallest dimension being in the vertical direction such that the vertical distance between its bottom wall 118 and the liquid level when the cartridge is full is about 10 mm. The bottom wall 118 has a recess 120 therein which acts as a sump.

A capillary wick 122 formed from a portion cut or stamped out from a sheet of a polymeric and resiliently deformable foam material, such as "Permair F" foamed polyesterurethane rubber, is located within the cartridge so as to be generally vertical with its lower end received within the recess 120 to allow liquid supply to its upper end to be maintained as the liquid level approaches the near empty condition. The upper end of the foam wick 122 projects through an opening defined by upstanding collar 124 and through an aperture 125 in the cover 115, locating means 126 being provided to position the wick 122 within the collar 124. The upper end of the wick is suitably profiled in the manner described above in relation to FIGS. 1 to 5 to produce two or more liquid ligaments, the number required and hence the number of teeth employed being selected according to the spraying rate required.

The cartridge 116 is adapted to provide for the connection of the liquid therein to the high voltage output of a high tension generator 128, the cartridge being formed from an electrically insulating material and having an electrical contact 130 located in the base of the recess 120 so that, when the cartridge is correctly located within the compartment 114, the contact 130 registers with a terminal 132 connected to the high voltage output of the generator 128. The bottom wall 118 of the compartment 114 includes a depression 134 for reception of the recess 120 so that when the cartridge is in place, the bottom wall 118 is generally parallel with the bottom wall 112. The compartment 114 and the depression may be so dimensioned and arranged that the cartridge can only make operative contact with the terminal 132 if inserted correctly in the housing.

The low voltage side of the generator 128 is connected to a low voltage circuit 140 including one or more batteries (typically 9 volts) and can be switched on or off by means of a user operable switch 144. The generator 128 produces a low current, high voltage output which is typically of the order of 5 to 15 kV and in use this voltage is applied to the liquid contents of the cartridge 116 to effect spraying of the liquid from the profiled upper edge of the wick 122. The low voltage circuit may be arranged to control the generator and thereby control spraying according to requirements. A connection from the low voltage circuit to earth is made through the bottom wall 112 of the housing.

The foam wick 122 provides sufficient capillary rise when disposed vertically to feed liquid from the cartridge to the profiled upper edge of the wick irrespective of the liquid level within the cartridge. By appropriate selection of the polymeric foam material and the dimensions of the wick 122, the rate of spraying from the profiled upper edge of the wick can be maintained substantially uniform as the liquid level progressively reduces from the fully filled condition to the near empty condition. For instance, by selection of the polymeric material in accordance with the criteria previously mentioned in relation to the embodiment of FIGS. 1 to 4, the spraying rate may be readily maintained within 10% of the rate achievable at the full condition as the liquid level reduces by 10 mm to the near empty condition.

An annular gap 142 is defined between the wick 122 and the collar 124 to allow the ingress of air as the liquid is discharged from the cartridge. The gap 142 is dimensioned so that, if the cartridge is inverted or otherwise oriented in a position in which the liquid could drain from the cartridge via the gap 142, the gap traps and holds the liquid by surface tension forces to prevent leakage. The cartridge is conveniently provided with a sealing cap (not shown) which can be fitted over the exposed upper end of the wick 122 and engages the collar 124, eg with a screw-threaded or snap-fit engagement, to seal the cartridge when not in use. Instead of allowing air ingress via a gap 142 as described above, the foam wick 122 may have a substantially sealed fit within the collar 124 and a separate air ingress port may be provided. This port may be fitted with a plug (not shorn) to prevent leakage, the plug being removed by the user, for example after or during insertion of the cartridge into the housing 110.

In use, the liquid is fed solely by the capillary action of the wick to the upper profiled edge of the wick where it is caused to issue as two or more ligaments (depending on the number of teeth presented by the profiled edge) which thereafter break up into electrically charged droplets, the droplets being drawn towards surrounding earthed objects within the vicinity, eg the ceiling and walls within a room to which fragrance is to be imparted. To prevent build up of electrical charge on the cover, the cover is fabricated from a semi-insulating material (typically having a bulk resistivity in the range from $10^{12}$ to $10^{14}$ ohm cm. for example a polyacetal such as "Delrin", and certain grades of rigid PVC) and an electrode 160 embedded within the cover 115 is connected to a low potential such as earth by a lead 162 so that any electrical charge accumulating on the cover is leaked away thereby preventing build up of a spray suppressing potential on the cover. Although the electrode is shown as being associated with the cover, it may be associated with the housing 110 and arranged so as to contact the cover 115 when the latter is in position on the housing thereby providing a leakage path to earth.

Instead of employing an electrode 160 to effect leakage of charge to earth, in an alternative embodiment the cover may be composed of a hydrophobic, highly insulating material (typically $10^{15}$ ohm cm and upwards, such as polypropylene) so that electrical charge accumulating on the cover as a result of charged droplets falling on to the cover, is substantially immobile thereby limiting the extent to which the cover may charge up and hence avoiding suppression of spraying.

Whilst not limited thereto, the invention is particularly applicable to devices for spraying liquid compositions suitable for use in personal care and hygiene products, such as deodorants, perfumes, anti-perspirants and hair sprays, and for use in spraying fragrances for air freshening.

We claim:

1. A method of producing a cartridge for use in an electrostatic spraying device comprising:

forming from a sheet of resiliently deformable non-fibrous, non-felted, hydrophobic material having open porosity a wicking element with a profiled spraying edge; furling said element about an axis of elongation thereof to facilitate insertion through an opening in the cartridge during assembly; and assembling said element to a container for liquid suitable for electrostatic spraying by inserting said element through an opening in the container so that said spraying edge projects from the container and a portion of the element extends into the interior of the container to provide a capillary feed path for liquid from the container to the profiled spraying edge.

2. A method as claimed in claim 1 in which said element is formed by cutting through the thickness of the sheet whereby said profiled edge is constituted by a cut edge of the sheet.

3. An electrostatic spraying device comprising:

a spraying nozzle in the form of an elongate wicking element one end of which forms the nozzle tip;

a reservoir containing liquid to be supplied to the nozzle tip;

means for applying high voltage to the liquid at the nozzle tip to cause the liquid to be drawn into ligamentary form and thereafter break up into electrostatically charged droplets; said wicking element being fabricated from a resiliently deformable material comprising an internal open cell core through which the liquid is drawn by capillary action and an exterior which is substantially impermeable, the open cell core being exposed at the tip end of the nozzle and being formed with at least one toothed feature from which liquid ligaments issue in use, the open cell core also being exposed within the reservoir to allow ingress of liquid.

4. An electrostatic spraying device comprising:

a spraying nozzle in the form of an elongate wicking element one end of which forms the nozzle tip;

a reservoir containing liquid to be supplied to the nozzle tip;

means for applying high voltage to the liquid at the nozzle tip to cause the liquid to be drawn into ligamentary form and thereafter break up into electrostatically charged droplets;

said wicking element being fabricated from a resiliently deformable material comprising an internal open cell core through which the liquid is drawn by capillary action and an exterior which is substantially impermeable and is integrally united with the core, the open cell core being exposed at the tip end of the nozzle and being formed with at least one toothed feature from which liquid ligaments issue in use, the open cell core also being exposed within the reservoir to allow ingress of liquid, and said means for applying high voltage to the liquid at the nozzle tip having a connection to the body of liquid in the reservoir whereby the high voltage is conducted from the body of liquid to the nozzle tip through the liquid drawn by capillary action along the length of the wicking material.

5. A device as claimed in claim 3 or 4 in which said material is composed of hydrophobic material.

6. A device as claimed in claim 3 or 4 in which said material is a polymeric material.

7. A device as claimed in claim 3 or 4 in which said material is composed of a material having a dielectric constant of at least 2.8 (measured an $10^6$ Hz).

8. A device as claimed in claim 3 or 4 in which the reservoir comprises a container into which said element extends and which is of squat configuration with its shortest dimension parallel with the axis of elongation of said element.

9. A device as claimed in claim 8 containing a liquid which is sprayable by the device and in which the element provides a capillary rise such that, when the device is disposed with said element directed vertically upwards, the spraying flow rate does not vary by more than 10% in response to the liquid level within the container ranging between the full and empty conditions of the container.

10. A personal care or hygiene spraying appliance comprising a device as claimed in claims 3 or 4 in which the liquid in the reservoir comprises a personal care or hygiene formulation.

11. A fragrance dispensing appliance comprising a device as claimed in claim 3 or 4 in which the liquid in the reservoir comprises an air freshening fragrance formulation.

12. A device as claimed in claim 3 in which the material is in the form of a sheet and is formed with a toothed profile at one edge thereof presenting at least one crest extending between opposite impermeable exterior faces of the sheet and through said internal core to form said at least one toothed feature.

13. A device as claimed in claim 3 in which the resiliently deformable material is in the form of a strip of elongated configuration and said at least one toothed feature is provided at one end of the strip.

14. A device as claimed in claim 13 in which said one end of the strip is provided with a plurality of teeth.

15. A device as claimed in claim 3 in which the thickness of the material is no greater than 2 mm.

16. A device as claimed in claim 3 in which the means for applying high voltage to the liquid at the nozzle tip comprises a high voltage generator and means connecting the high voltage output of the generator to the body of liquid within the reservoir whereby the voltage is conducted from the body of liquid to the nozzle tip through the liquid drawn by capillary action along the length of the wicking element.

17. A cartridge for use in an electrostatic spraying device comprising a container forming a reservoir for liquid to be sprayed and a spraying nozzle in the form of an elongate wicking element one end of which forms the nozzle tip, said wicking element being fabricated from a resiliently deformable material comprising an internal open cell core through which the liquid is drawn by capillary action and an exterior which is substantially impermeable, the open cell core being exposed at the tip end of the nozzle and being formed with at least one toothed feature from which liquid ligaments issue in use, the open cell core also being exposed within the reservoir to allow ingress of liquid.

18. A cartridge as claimed in claim 17 in which the material is in the form of a sheet and is formed with a toothed profile at one edge thereof presenting at least one crest extending between opposite impermeable exterior faces of the sheet and through said internal core to form said at least one toothed feature.

19. A cartridge as claimed in claim 17 in which the resiliently deformable material is in the form of a strip of elongated configuration and said at least one toothed feature is provided at one end of the strip.

20. A cartridge as claimed in claim 19 in which said one end of the strip is provided with a plurality of teeth.

21. A cartridge as claimed in claim 19 in which the thickness of the material is no greater than 2 mm.

22. A cartridge as claimed in claim 17 in which said exterior of the wicking element is integrally united with the core thereof.

23. A cartridge as claimed in any one of claims 17 to 22 having means for connecting liquid within the reservoir to a source of high voltage external to the cartridge whereby, in use, the voltage is conducted from the body of liquid to the nozzle tip through the liquid drawn by capillary action along the length of the wicking element.

24. A cartridge as claimed in any one of claims 17 to 22 which is of squat configuration with its shortest dimension parallel with the axis of elongation of said element.

* * * * *